United States Patent [19]

Gold

[11] 4,121,563

[45] Oct. 24, 1978

[54] FUEL SAVING FURNACE IMPROVEMENT

[75] Inventor: Paul B. Gold, Newton, Mass.

[73] Assignee: Walter J. Kreske, Newton, Mass. ; a part interest

[21] Appl. No.: 771,017

[22] Filed: Feb. 22, 1977

[51] Int. Cl.[2] ..... F24H 3/12

[52] U.S. Cl. ..... 126/116 A; 126/400; 110/323; 122/367 PF; 432/215

[58] Field of Search ..... 110/97 R; 122/367 PF; 165/DIG. 4, 104 S; 126/344, 400, 99 R, 116 R, 116 A; 432/215

[56] References Cited

U.S. PATENT DOCUMENTS

| | | | |
|---|---|---|---|
| 655,274 | 8/1900 | Ramsden | 122/367 PF |
| 1,751,581 | 3/1930 | Gould | 110/97 R |
| 2,121,733 | 6/1938 | Cottrell | 122/4 D |
| 2,294,579 | 9/1942 | Sherman | 110/97 R |
| 3,400,248 | 9/1968 | Isomaa | 126/344 |

FOREIGN PATENT DOCUMENTS

| | | | |
|---|---|---|---|
| 473,355 | 5/1951 | Canada | 110/323 |

*Primary Examiner*—John J. Camby
*Assistant Examiner*—Larry I. Schwartz
*Attorney, Agent, or Firm*—Walter J. Kreske

[57] ABSTRACT

A fuel saving improvement in conventional home, commercial and public building heating furnaces comprising the inclusion of heat absorbing members such as stones on rod mesh trays in the normally substantial amount of unoccupied space above the furnace combustion chamber. The trays carrying the heat absorbing members are held, one above the other, by a metal support frame resting on the refractory material of the combustion chamber. The stones or other heat absorbing members are each at least three inches in cross sectional dimension and in spaced relation to each other. And the heat absorbing members in each tray are positioned above the respective open spaces between the stones in the next lower tray to cause a tortuous path for the heat and energy passing from the heating flame in the combustion chamber to the furnace flue opening. The heat absorbing members thereby absorb heat from the heating flames which would normally be lost to the flue opening during "ON" periods of the heating flame. During "OFF" periods of the heating flame, the heat absorbed by the heat absorbing members continues to provide furnace heat thereby reducing the length of needed "ON" periods of the heating flame in the combustion chamber and thus reducing fuel consumption by the furnace.

10 Claims, 4 Drawing Figures

Fig. 1.
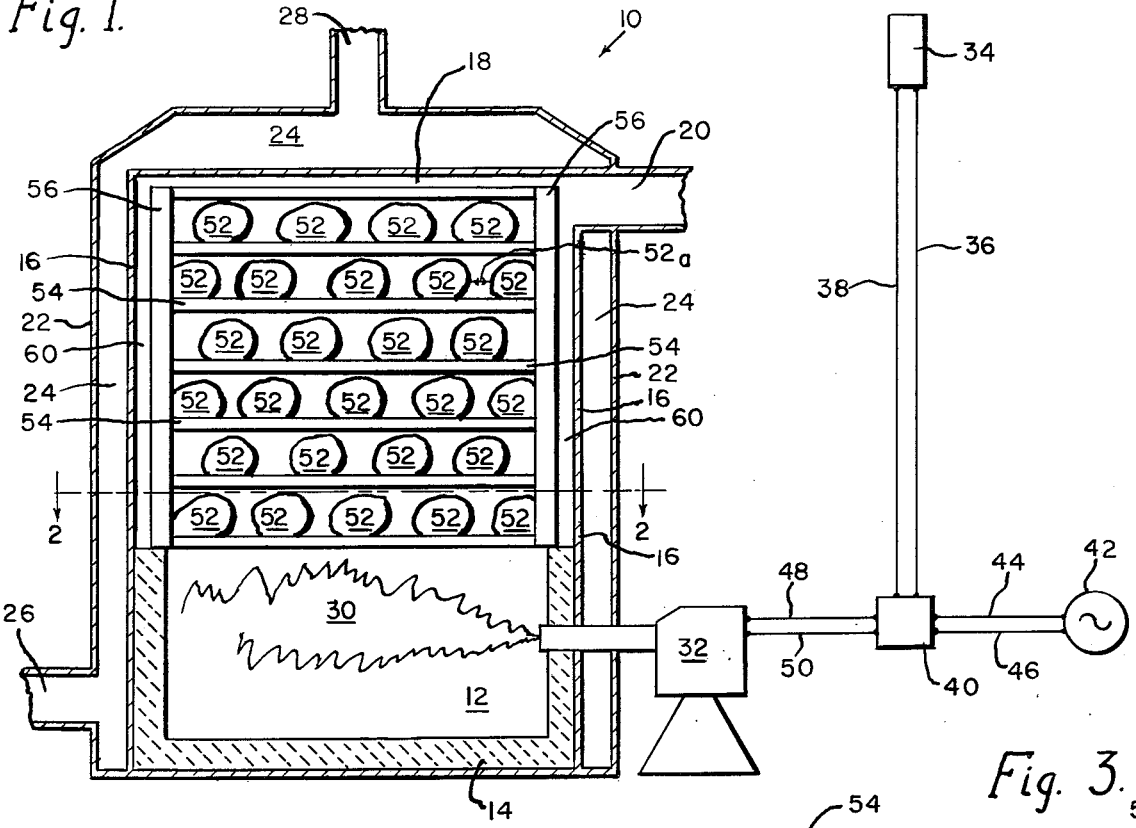
Fig. 3.
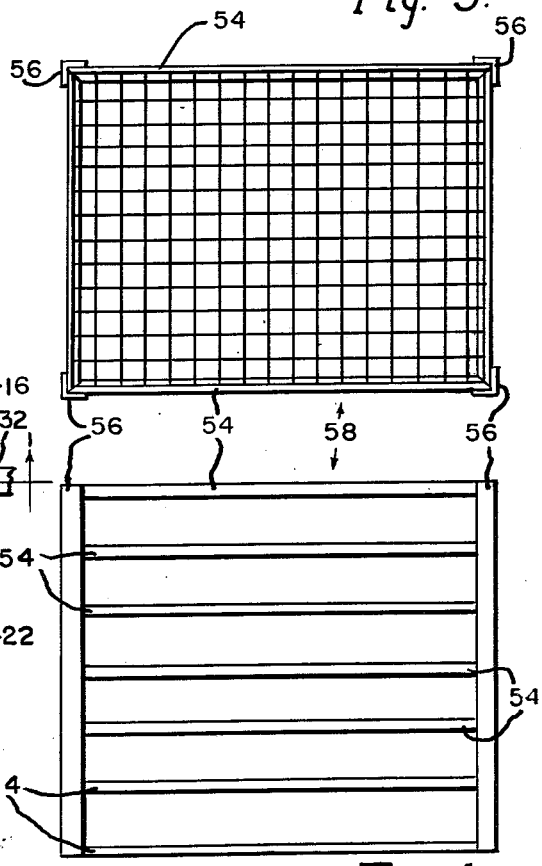
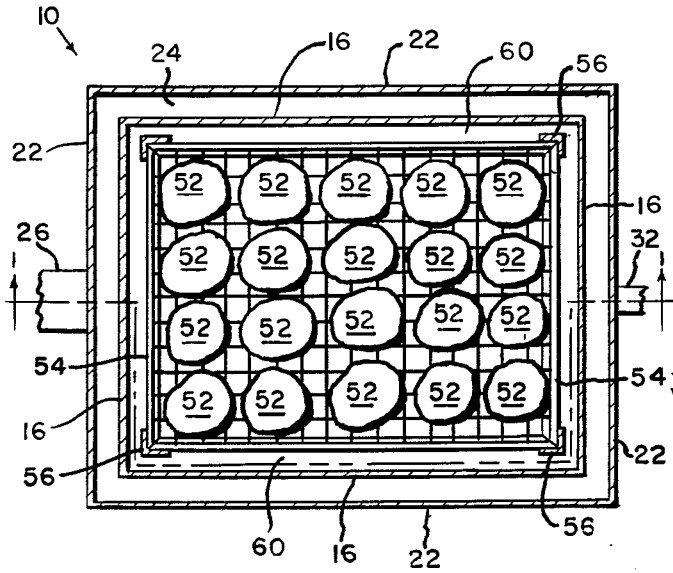
Fig. 2.
Fig. 4.

FUEL SAVING FURNACE IMPROVEMENT

BACKGROUND OF THE INVENTION

1. Field of the Invention

The present invention relates to furnaces for heating homes, commercial and public buildings and more particularly to a fuel saving structure for incorporation into existing as well as new furnaces to capture and utilize heat which would otherwise normally be lost through the flue and stack pipe and hence up the chimney.

2. Prior Art

The shortages and increasing costs of both oil and gas as fuels used in furnaces for heating homes, commercial and public buildings make it increasingly important that such furnaces make maximum utilization of the heat generated by such fuels in the furnaces. Conventional furnaces for hot air, hot water, or steam heating or buildings such as homes and the like, particularly hot air furnaces, usually have a substantial amount of space above the refractory material which forms the combustion chamber. The walls about this space are of metal and the heat and other products of combustion, in passing through this space to the flue, heat the space walls which form a heat exchanger for heating the air or other fluid medium on the other side of these space walls. Such heated fluid medium, usually air, water or steam, is in turn used to heat the building. However, much of the heat from the heating flame in the combustion chamber passes with the other products of combustion through this space above the combustion chamber to the flue opening and is lost through the stack and up the chimney.

The present invention incorporates in this open space a structure for absorbing and storing much of this normally lost heat during the "ON" periods of the heating flame in the combustion chamber and for this absorbed heat to thereafter continue to provide furnace heat during the "OFF" periods of the heating flame in the combustion chamber. The result is a greater utilization of heat generated by the fuel in the combustion chamber and thus a substantial saving in fuel.

While there are some existing structures which have been devised with heat absorbing material to store heat and subsequently discharge such stored heat for a particular purpose, such structures have generally required increased rather than decreased amounts of fuel than would be required if operated without the heat absorbing materials, and fail to recognize applicability for saving fuel in conventional furnaces for heating homes, commercial and public buildings. For example, U.S. Pat. Nos. 2,565,676 and 3,110,797 disclose stove structures for heating stones which are subsequently sprayed with water to generate steam for a steam bathroom. And stones are used with water in U.S. Pat. No. 3,369,541 to store heat from solar heat collectors to help in keeping the stored water warm. In U.S. Pat. No. 3,301,251 electric heating elements heat large slabs of concrete for subsequent use in an air conditioning system. Also, in U.S. Pat. Nos. 2,776,825, 2,890,876 and 3,493,344 a category of special purpose furnaces known a "pebble furnaces" for heat exchanger application in chemical processes use pebbles up to about one inch in diameter generally where temperatures are too high and conditions too severe for even the best alloy steels. Such pebble furnaces work on a relatively complicated timing movement of pebbles not reasonably applicable to the problem of saving fuel in conventional furnaces used in heating buildings such as homes and the like.

The present invention as will hereinafter become apparent provides a relatively simple and inexpensive solution to the problem of saving fuel in furnaces for heating homes, commercial and public buildings. The invention does not require close tolerance work nor the use of expensive materials and is applicable to any such furnace which has a substantial amount of space above the combustion chamber and "ON" and "OFF" periods of the heating flame in the combustion chamber, regardless of whether the furnace is for hot air, hot water or steam heating of the building. The invention is particularly applicable to gas and to oil fired furnaces.

SUMMARY OF THE INVENTION

In accordance with the present invention, there is provided in a furnace for heating a home, commercial or public building in which the furnace is of the type having a combustion chamber for a heating flame, a substantial amount of normally unoccupied space above the combustion chamber, a flue opening for coupling to a chimney, means for carrying a fluid medium such as air, water or steam, about the walls of the normally unoccupied space for receiving heat through the walls from the heating flame for use in heating the building, and means for causing the heating flame to go "ON" and "OFF" in the combustion chamber in accordance with selected heating needs of the building, the improvement comprising the inclusion of refractory type heat absorbing members in the normally unoccupied space above the combustion chamber and positioned in the path of the products of combustion from the heating flame to the flue opening. The refractory type heat absorbing members thereby absorb heat normally lost through the flue during such "ON" periods of the heating flame in the combustion chamber and subsequently supply heat to the fluid medium about the normally unoccupied space during the "OFF" periods of the heating flame. Thus the length of "ON" periods of the heating flame are reduced with a consequent saving in fuel.

By using stones, lava rock, concrete, or the like as the refractory type heat absorbing members, readily available, inexpensive, economical and relatively simple heat absorbing arrangement in the furnace is thereby achieved.

By placing the heat absorbing members on trays, one above the other, with the trays having openings for passage of the products of combustion from the heating flame about the heat absorbing members, a simple arrangement for providing effective pathways for the products of combustion together with proper balance of heat transfer to the heat absorbing members is thereby achieved.

By using stones or other heat absorbing members of substantially uniform cross section such that the average "ON" time period of the heating flame is sufficient to cause the temperature at the center of the heat absorbing members to rise to substantially that of the temperature at the outer periphery of the heat absorbing members, a substantial degree of fuel saving capability of the invention is there by achieved.

By retaining a cross sectional dimension of the hest absorbing members of at least three inches and placing them in spaced relation to each other on the trays, an arrangement for insuring suitable flow of products of combustion from the heating flame to the flue outlet is thereby achieved.

By providing for placement of each of the heat absorbing members in respective open spaces between the members in the next lower tray a desirable tortuous path causing increased rate of heating of the members without undue obstruction to flow of the products of combustion is thereby achieved.

By using heat absorbing members with a cross sectional dimension such that in average "ON" and "OFF" periods of a cycle of the heating flame, the temperature at the center of each of the heat absorbing members will rise sufficiently during the "ON" period of the heating flame to subsequently fall to nearly the temperature of the fluid medium about the normally unoccupied space at the end of the "OFF" period of the heating flame a substantial utilization of the heat absorbing members for heat utilization and thereby for substantial fuel saving by the furnace is thereby achieved.

By making the trays of rod mesh, relatively simple, versatile and inexpensive structure for holding the heat absorbing members at selected positions without undue obstruction to flow of products of combustion from the heating flame to the flue outlet is thereby achieved.

By providing a metal support frame for holding the trays one above the other with the support frame having a width, breadth and height dimensions substantially smaller than the respective dimensions within the normally unoccupied space above the combustion chamber, a relatively simple and easily manufacturable structure with liberal dimensional tolerances is thereby achieved.

By making the frame in the form of upright angle iron members at each of four corners resting on the refractory material of the combustion chamber, ready adaptibility to existing as well as new furnace installations is thereby achieved.

These and other features, objects and advantages of the present invention will be better understood from the following detailed description and accompanying drawings wherein like numerals refer to like parts throughout the several views and wherein:

BRIEF DESCRIPTION OF THE DRAWINGS

FIG. 1 is a diagramatic illustration of a furnace improved for fuel saving in accordance with the present invention and shown in cross section taken on line 1—1 of FIG. 2;

FIG. 2 is a cross sectional view of the FIG. 1 embodiment taken on line 2—2 of FIG. 1;

FIG. 3 is a top view of a tray stand for holding heat absorbing refractory members used in the FIG. 1 embodiment;

FIG. 4 is a front elevation of the FIG. 3 illustrative tray stand.

DESCRIPTION OF THE ILLUSTRATIVE EMBODIMENT

Referring to the drawings in more detail, a conventional furnace for heating a home, commercial or public building and improved for fuel saving in accordance with the present invention is designated generally by the numeral 10 in FIGS. 1 and 2. The furnace 10 has a conventional combustion chamber 12 formed by refractory material 14 such a firebrick which is confined within an inside metal furnace wall enclosure 16 having a substantial amount of normally unoccupied space 18 above the combustion chamber 12. At the upper portion of the normally unoccupied space 18 is a conventional flue opening 20 for coupling to a chimney in conventional manner (not shown). Spaced from the inside wall enclosure 16 is an outside furnace wall enclosure 22 to form a space 24 between the inner and outer furnace enclosure walls 16 and 22 respectively for carrying a fluid medium such as air in the case of hot air furnaces or water in the case of hot water or steam heating furnaces. The outside furnace enclosure wall 22 has a conventional inlet duct 26 and outlet duct 28 for circulation of the fluid medium in conventional manner to and from the building (not shown) to be heated by the furnace 10.

A heating flame 30 in the combustion chamber 12 from a suitable burner, for example such as a conventional oil burner 32 or from a conventional gas burner, creates heat which as it passes with other products of combustion to the outlet flue 20 heats the inside metal furnace wall 16 as a heat exchanger to heat the fluid medium in the space 24. The so heated fluid medium in space 24 in turn passes through the outlet duct 28 to the building being heated and the exiting fluid medium is replaced through the inlet duct 26. A thermostat 34 at a suitable position in the area being heated is coupled by electric cables 36 and 38 to a suitable relay 40 for controlling the flow of electric power from a suitable power source 42 such as the conventional 110 volt, 60 cycle electrical supply service through electric cables 44, 46, 48 and 50 to the burner 32. When the area about the thrmostat 34 reaches a selected temperature, the thermostat 34 will cause the relay to break the circuit to the burner 32 and thereby stop the heating flame 30. Conversely when more heat is needed, the thermostat 34 will cause relay 40 to close the circuit to the burner 32 to again create the heating flame 30 to again heat the fluid medium in the space 24 through the heat exchanger metal wall 16. In this manner the thermostat 34 causes "ON" and "OFF" periods of heating flame 30 in the combustion chamber 12 to satisfy the selected heating needs set on the thermostat 34.

While during the "ON" periods, the heating flame 30 does heat the fluid medium in space 24 through the heat exchanger wall 16, a large portion of the heat from the heating flame 30 is normally lost through the flue 20 to the chimney. To capture much of this heat which is normally lost, the present invention incorporates in the normally unoccupied space 18 a plurality of heat absorbing members 52 preferably of such inexpensive and easily available material as stone, lave rock, concrete or the like which can withstand without deterioration the furnace heat and repetitive hot and cold cyclic periods. The heat absorbing members 52 are carried in spaced relation to each other on suitable trays such as rod mesh trays 54 carried one above the other by being fastened to four upright members 56 such as angles irons at the respective tray corners to form a tray stand 58 resting on the top of the refractory material 14 of the combustion chamber 12. The height, width and breadth dimensions of the tray stand are suitably smaller than the corresponding dimensions of the space 18 so as to leave such space as 60 adjoining the wall 16 for heating purposes to be hereinafter described and to avoid the need for close tolerance fabrication of the tray stand 58.

The heat absorbing members 52 as shown in FIG. 1 are preferably placed on the trays 54 in manner such that each heat absorbing member 52 is located above the open space such as **52*a* between the heat absorbing members 52 in the next lower tray 54**. Such placement causes the products of combustion from the heating flame 30 to move in a tortuous path about the heat absorbing members 52 and in the space 60 against the heat exchanger wall 16. Thus, during each "ON" period of the heating flame 30 the fluid medium in the space 24 will continue to receive heat through the heat exchanger wall 16, but much of the heat which had theretofore been lost through normally unoccupied space 18 to the flue 20 will be absorbed by the heat absorbing members 52 so that when the heating flame 30 is extinguished in the "0FF" period, the members 52 will continue to supply furnace heat through the heat exchanger wall 16 to the fluid medium in the space 24. And the so heated fluid medium in the space 24 continues to be available for flow through the outlet 28 to the building as needed under the control of conventionally controlled circulatory system (not shown) coupled to the outlet 28 for using this reserve heat energy as needed in the building. Such control system for heat flow from outlet 28 as well as damper and draft controllers in the chimney coupling to the flue outlet 20 are of a conventional nature and do not form a part of the present invention. Thus this capture and utilization of the heretofore normally lost heat results in a substantial saving in the amount of fuel needed by burner 32 for heating the building at a selected temperature on the thermostat 34.

The heat absorbing members 52 are preferably of a cross sectional size such that during an average "ON" period of the heating flame 30 the temperature at the center of each of the heat absorbing members 52 will rise to substantially the temperature in the chamber 18, and by the end of the following "OFF" period of the heating flame 30 the temperature of the members 52 will have dropped to nearly that of the setting on the thermostat 34. Thereby, the members 52 will have not only contributed substantially to the saving of fuel, but will also have contributed substantially to the maintenance of a more even temperature in the building being heated by the furnace 10.

Also, the heat absorbing members 52 are preferably of a size at least three inches in cross section and spaced from each other for effecting a proper balance of heat transfer to the members 52 and heat exchanger wall 16 and sufficient draft, in conjunction with conventional damper and draft control in the flue outlet 20 coupling to the chimney, for proper combustion of the heating flame 30.

This invention is not limited to the particular details of construction and operation described as equivalents will suggest themselves to those skilled in the art. For example, while the FIG. 2 illustration shows the illustrative embodiment to have a rectangular cross sectional shape, the present invention contemplates furnaces of circular, oval or other cross sectional shapes.

What is claimed is:

1. In a furnace for heating a building, the furnace being of the type having a combustion chamber for a heating flame therein, a substantial amount of normally unoccupied space above the combustion chamber and a flue opening for coupling to a chimney, means for carrying a fluid medium about the walls of said space for receiving through the walls heat from said heating flame for heating said building, and means for causing said heating flame to go "ON" and "OFF" in said combustion chamber in accordance with selected heating needs of said building; the improvement comprising the inclusion of refractory type heat absorbing members in said normally unoccupied space, said heat absorbing members being in sufficient quantity for substantially filling said normally unoccupied space; and means for carrying said heat absorbing members in spaced relation to each other and in spaced relation to said walls for permitting substantially free passage of products of combustion from said heating flame about each of said heat absorbing members and between said heat absorbing members and said walls, and positioned in the path of products of combustion from said heating flame as said products of combustion pass from said heating flame to said flue opening for thereby reducing loss of heat to said flue opening.

2. The improvement as in claim 1 wherein said heat absorbing members are one or more from the group consisting of stones, concrete and lava rock.

3. The improvement as in claim 2 wherein said stones are in single layers on trays, one above the other, and having openings for passage of said products of combustion from said heating flame about said stones to said flue opening.

4. The improvement as in claim 3 wherein each of said stones is at least three inches in cross sectional dimension.

5. The improvement as in claim 4 wherein said stones in each tray above the next lower tray are placed in the respective open space between stones in said next lower tray to thereby cause a tortuous path for said products of combustion as said products of combustion pass from said heating flame to said flue opening.

6. The improvement as in claim 4 wherein the cross sectional size of each of said stones is such that in an average "ON" and "OFF" periods in the cycle of said heating flame the temperature at the center of each of said stones will rise sufficiently during the "ON" portion of said heating flame cycle to still be above the temperature of said fluid medium about said space at the end of said "OFF" portion of said heating flame cycle to thereby provide substantial utilization of said stones for heat conservation by said furnace.

7. The improvement as in claim 3 wherein said trays are comprised of a rod mesh.

8. In a furnace for heating a building, the furnace being of the type having a combustion chamber for a heating flame therein, a substantial amount of normally unoccupied space above the combustion chamber and a flue opening for coupling to a chimney, means for carrying a fluid medium about the walls of said space for receiving through the walls heat from said heating flame for heating said building, and means for causing said heating flame to go "ON" and "OFF" in said combustion chamber in accordance with selected heating needs of said building; the improvement comprising the inclusion of refractory type heat absorbing members which are one or more from the group consisting of stones, concrete and lava rock, said heat absorbing members being on trays comprised of rod mesh, one above the other in said normally unoccupied space and positioned in the path of products of combustion from said heating flame and having openings for passage of said products of combustion from said heating flame about said heat absorbing members as said products of combustion pass from said heating flame to said flue opening for thereby reducing loss of heat to said flue opening; and said trays are held one above the other in the form of a metal support frame having width, breadth and height dimensions substantially smaller than the corresponding dimensions of said normally unoccupied space above said combustion chamber to provide space for flow of said products of combustion against said walls about the normally unoccupied space above said combustion chamber.

9. The improvement as in claim 8 wherein said support frame is comprised of an upright member at each of four corners and resting on said combustion chamber, and horizontal members fixed to said upright members at each of the trays to form the sides of said frame and provide support for the respective ones of said trays.

10. The improvement as in claim 9 wherein said upright and horizontal members are of angle iron.

* * * * *